US006564838B1

(12) United States Patent
Cruickshank

(10) Patent No.: US 6,564,838 B1
(45) Date of Patent: May 20, 2003

(54) HANDBAG WITH DRAWSTRING CLOSURE

(76) Inventor: Halsey Cruickshank, 1431 E. 108th St. Apt. #10D, Brooklyn, NY (US) 11236

( * ) Notice: Subject to any disclaimer, the term of this patent is extended or adjusted under 35 U.S.C. 154(b) by 0 days.

(21) Appl. No.: 10/103,930

(22) Filed: Mar. 22, 2002

(51) Int. Cl.[7] ..... A45C 3/06; A45C 13/10; A45C 13/26

(52) U.S. Cl. ..... 150/118; 150/128; 150/129; 150/130; 383/76

(58) Field of Search ..... 150/118, 127, 150/129, 130; 206/315.9; D3/232, 234, 237, 238, 244; 383/72, 76

(56) References Cited

U.S. PATENT DOCUMENTS

| | | | | | |
|---|---|---|---|---|---|
| D19,591 | S | * | 1/1890 | Cottle | D3/244 |
| 595,685 | A | * | 12/1897 | Abraham | 383/76 X |
| 665,942 | A | * | 1/1901 | Tabler | 383/72 X |
| 1,683,678 | A | | 9/1928 | Kitterman et al. | |
| D115,541 | S | * | 7/1939 | Cohen et al. | D3/238 |
| 2,253,688 | A | * | 8/1941 | Collins | 383/76 X |
| D139,335 | S | * | 11/1944 | De Kolb | D3/238 |
| 2,377,311 | A | * | 6/1945 | Campbell | 383/76 X |
| 2,552,443 | A | * | 5/1951 | Molinari | 383/72 X |
| D165,483 | S | | 12/1951 | Rosenberg et al. | |
| D167,959 | S | | 10/1952 | Stucker | |
| 2,792,043 | A | | 5/1957 | Mclean | |
| D220,414 | S | * | 4/1971 | Marshall | D3/244 |
| 4,156,446 | A | * | 5/1979 | Nathan | 383/76 X |
| D261,075 | S | | 10/1981 | Dolas | |
| 4,646,804 | A | * | 3/1987 | Damiano | 150/130 X |
| D307,064 | S | * | 4/1990 | Roberts | D3/244 |
| 5,135,222 | A | * | 8/1992 | Spector | 383/76 X |
| 5,535,543 | A | * | 7/1996 | Alexander | 383/72 X |
| D380,609 | S | | 7/1997 | Formby | |
| 6,286,674 | B1 | * | 9/2001 | Richard et al. | 206/315.9 |

FOREIGN PATENT DOCUMENTS

| | | | | |
|---|---|---|---|---|
| GB | 496156 | * | 11/1938 | 383/76 |

* cited by examiner

*Primary Examiner*—Sue A. Weaver

(57) ABSTRACT

A calabash shaped handbag for carrying personal effects. The handbag includes a dome shaped bottom portion connected with a band to a more pliant upper portion. The top opening would include a drawstring for closing the bag, which is attached to the exterior of the bag to form a handle or shoulder strap.

16 Claims, 6 Drawing Sheets

HANDBAG WITH DRAWSTRING CLOSURE

BACKGROUND OF THE INVENTION

1. Field of the Invention

The present invention relates to hand bags and more particularly pertains to a new handbag for carrying personal effects.

2. Description of the Prior Art

The use of handbags is known in the prior art. More specifically, handbags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,683,673 which teaches a handbag with a folding closure system that includes a pair of drawstrings. The patent does not teach a handbag with a domed bottom or the use of a single drawstring.

U.S. Pat. No. 2,792,043 teaches a handbag composed of a lower section constructed of walls of cork disks including a flat bottom. The upper section comprising a fabric neck and drawstring. The patent does not teach a relatively dome shaped bottom or the connection of the drawstring to the bag exterior to form a handle.

U.S. Design Pat. No. D 167,959 teaches the ornamental design for a handbag comprising a pouch formed by two flat square pieces. The patent does not teach a dome-bottomed bag with a drawstring closure attached to the exterior of the case to form a handle.

U.S. Design Pat. No. D 380,609 teaches an ornamental design for a handbag comprising a flat bottomed pouch with drawstring and separate shoulder strap. The patent does not teach a dome-bottomed bag with a drawstring closure attached to the exterior of the case to form a handle.

U.S. Design Pat. No. D 165,483 teaches an ornamental design for a handbag comprising a flat-bottomed sphere with hinged wire closure and dual handles. The patent does not teach a dome-bottomed bag with a drawstring closure attached to the exterior of the case to form a handle.

U.S. Design Pat. No. D 261,075 teaches an ornamental design for a pouch comprising a material bag with drawstring closure. The patent does not teach a dome-bottomed bag with a drawstring closure attached to the exterior of the case to form a handle.

While these devices fulfill their respective, particular objectives and requirements, the aforementioned patents do not disclose a new handbag. The inventive device includes a dome shaped bottom portion connected with a band to a more pliant upper portion. The top opening would include a drawstring connected to the band to form a handle.

In these respects, the handbag according to the present invention substantially departs from the conventional concepts and designs of the prior art, and in so doing provides an apparatus primarily developed for the purpose of carrying personal effects.

SUMMARY OF THE INVENTION

In view of the foregoing disadvantages inherent in the known types of handbags now present in the prior art, the present invention provides a new handbag construction wherein the same can be utilized for carrying personal effects.

The general purpose of the present invention, which will be described subsequently in greater detail, is to provide a new handbag apparatus and method which has many of the advantages of the handbags mentioned heretofore and many novel features that result in a new handbag which is not anticipated, rendered obvious, suggested, or even implied by any of the prior art handbags, either alone or in any combination thereof.

To attain this, the present invention generally comprises a handbag with a dome shaped bottom portion connected with a band to a more pliant upper portion. The top opening would include a drawstring connected to the band to form a handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handbag apparatus and method which has many of the advantages of the handbags mentioned heretofore and many novel features that result in a new handbag which is not anticipated, rendered obvious, suggested, or even implied by any of the prior art handbags, either alone or in any combination thereof.

It is another object of the present invention to provide a new handbag, which may be easily and efficiently manufactured and marketed.

It is a further object of the present invention to provide a new handbag, which is of a durable and reliable construction.

An even further object of the present invention is to provide a new handbag, which is susceptible of a low cost of manufacture with regard to both materials and labor, and which accordingly is then susceptible of low prices of sale to the consuming public, thereby making such handbag economically available to the buying public.

Still yet another object of the present invention is to provide a new handbag, which provides in the apparatuses and methods of the prior, art some of the advantages thereof, while simultaneously overcoming some of the disadvantages normally associated therewith.

Still another object of the present invention is to provide a new handbag for carrying personal effects.

Yet another object of the present invention is to provide a new handbag, which includes a dome shaped bottom portion connected with a band to a more pliant upper portion. The top opening would include a drawstring connected to the band to form a handle.

Still yet another object of the present invention is to provide a new handbag that stylish and appealing to the eye as well as functional.

Even still another object of the present invention is to provide a new handbag that is comfortable to carry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
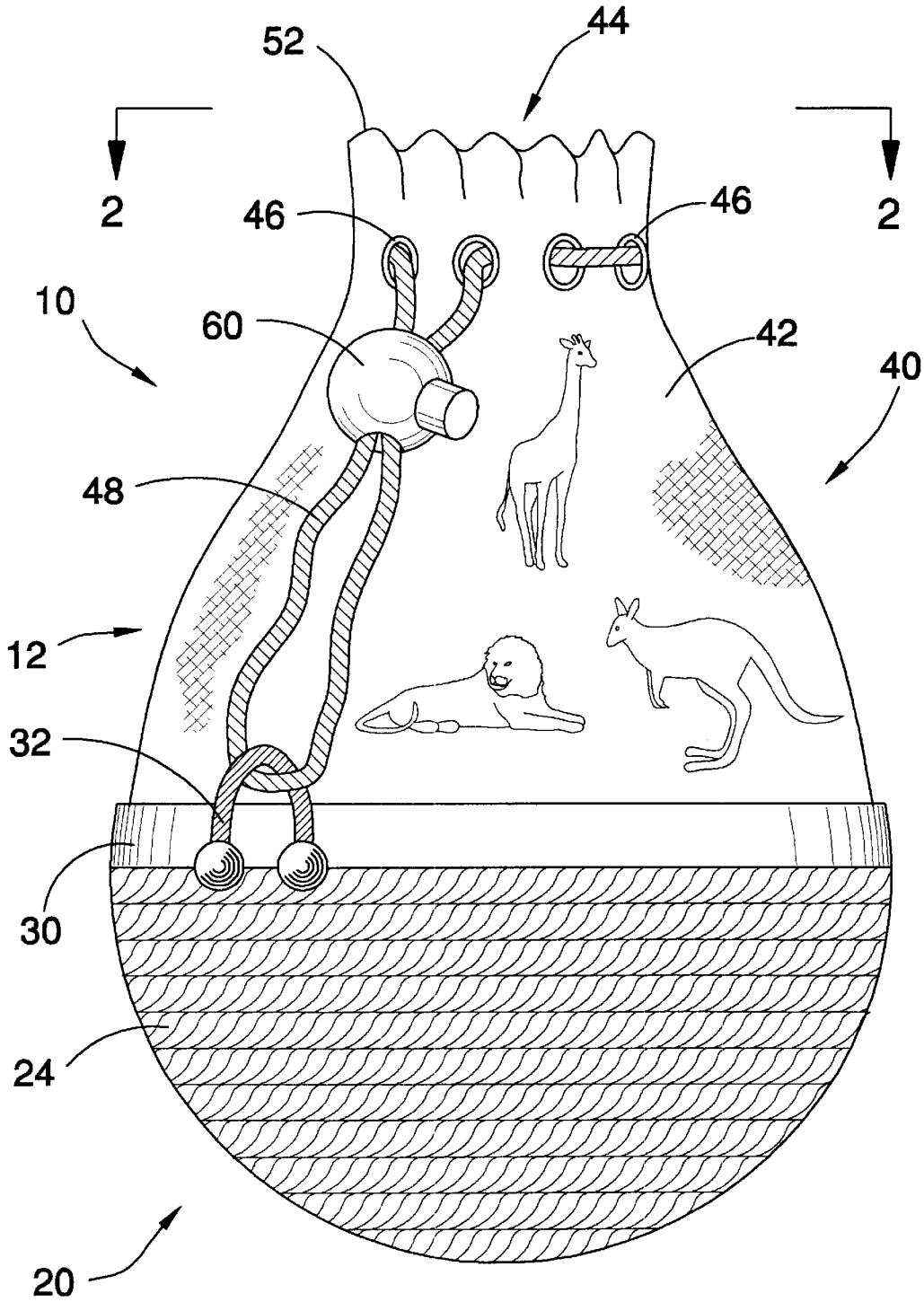
FIG. 1 is a front view of a new handbag according to the present invention.
Figure 2:
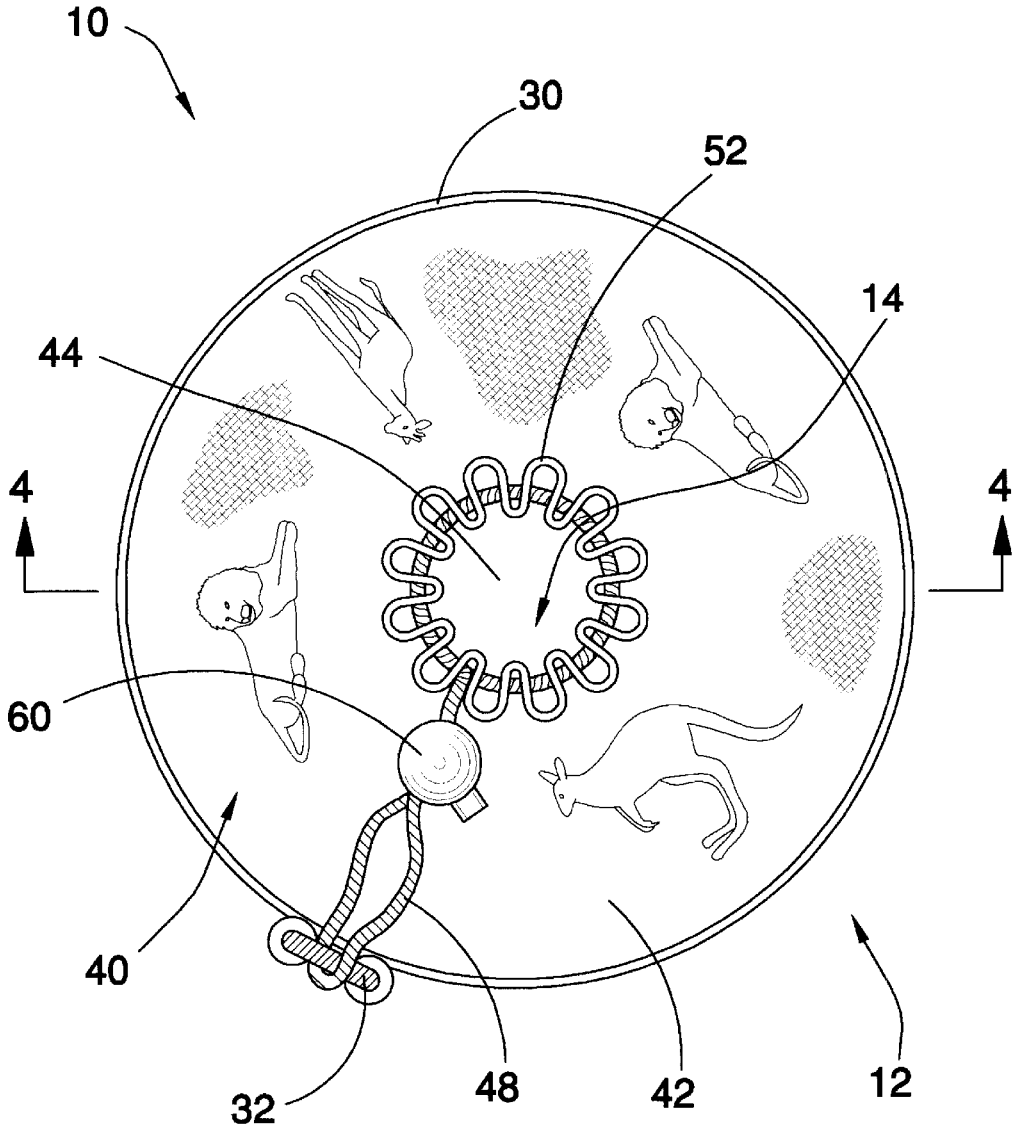
FIG. 2 is a top view of the present invention.
Figure 3:
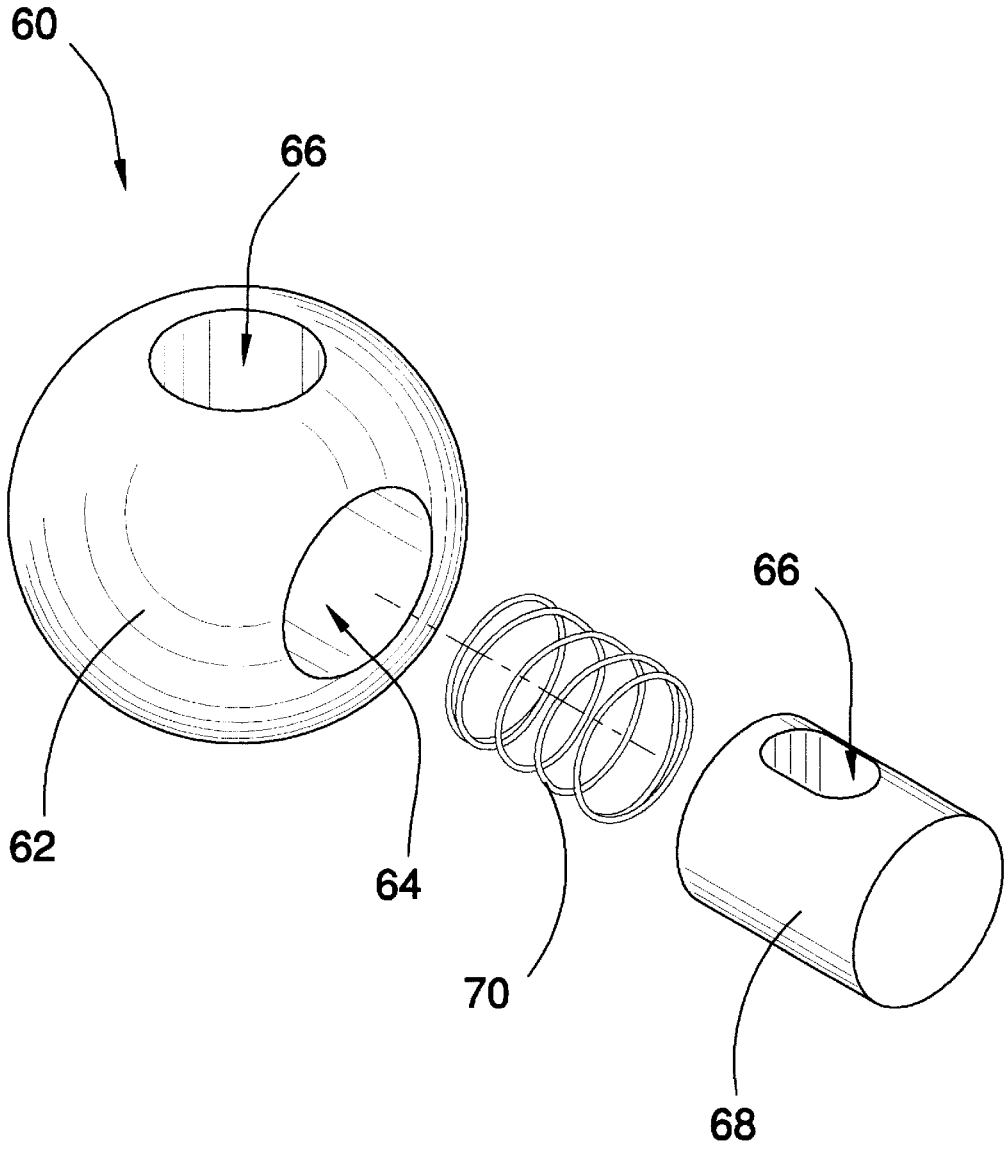
FIG. 3 is an exploded view of the drawstring spring clamps of the present invention.
Figure 4:
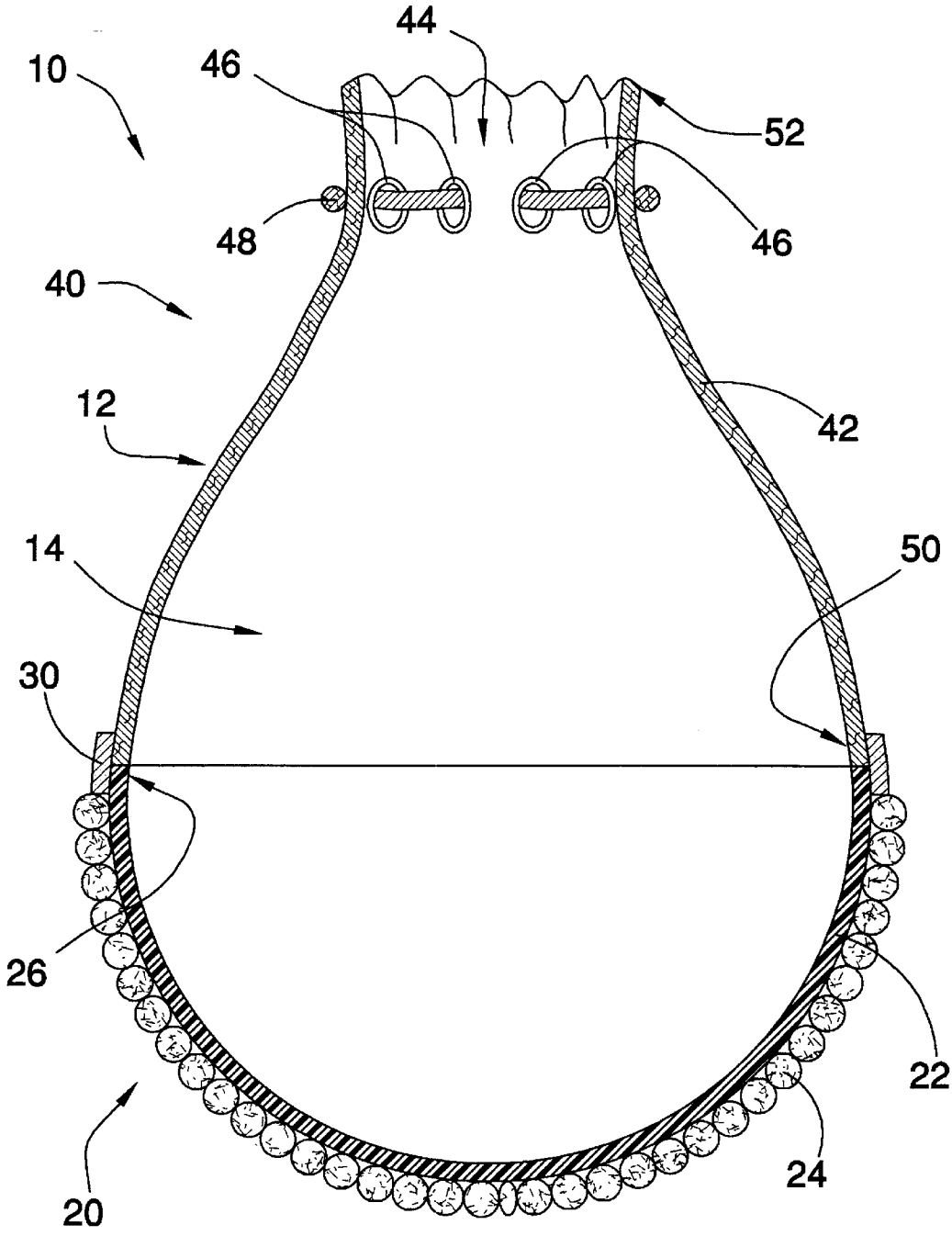
FIG. 4 is a cross sectional view of the present invention.
Figure 5:
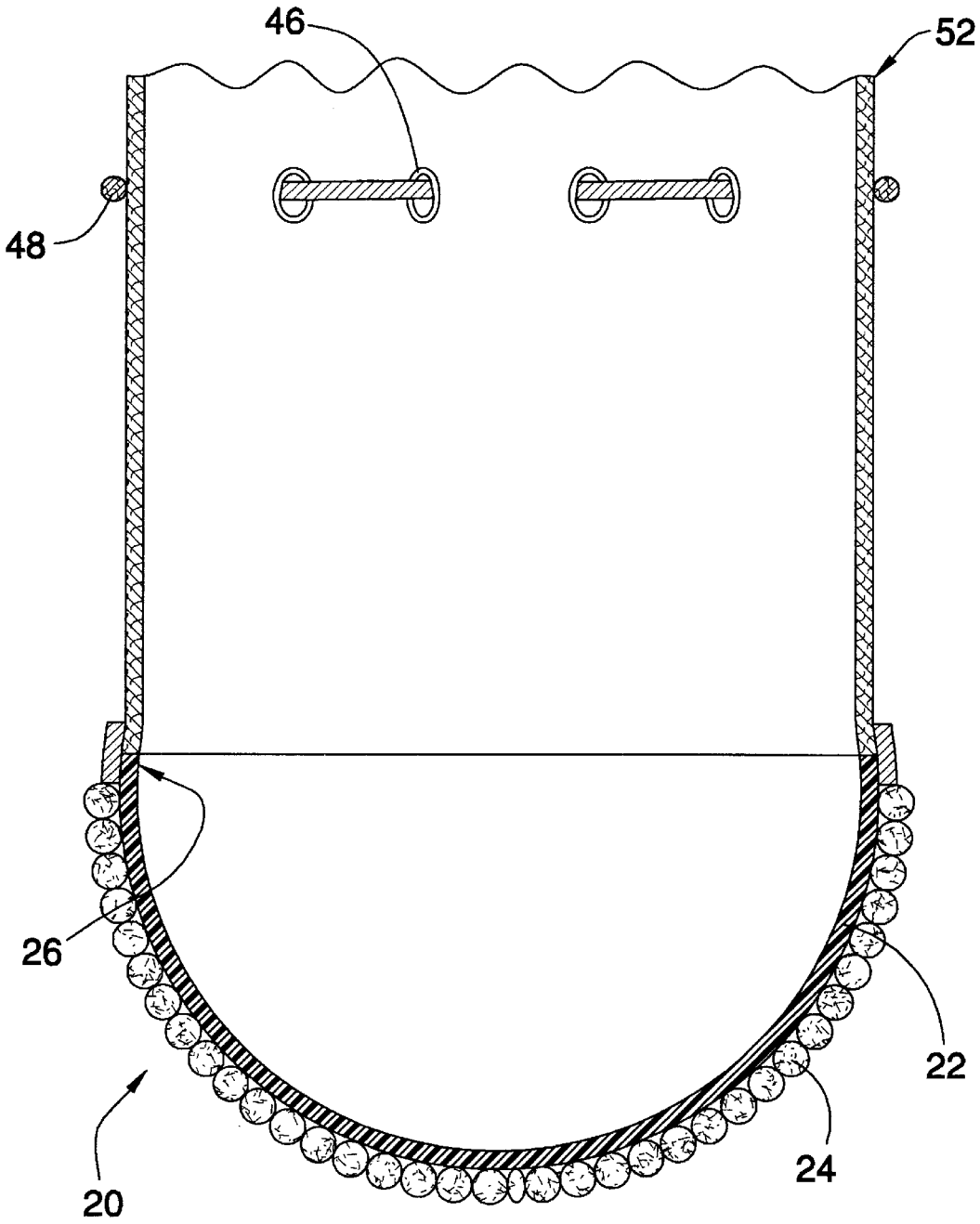
FIG. 5 is a cross sectional view of an embodiment of the present invention.
Figure 6:
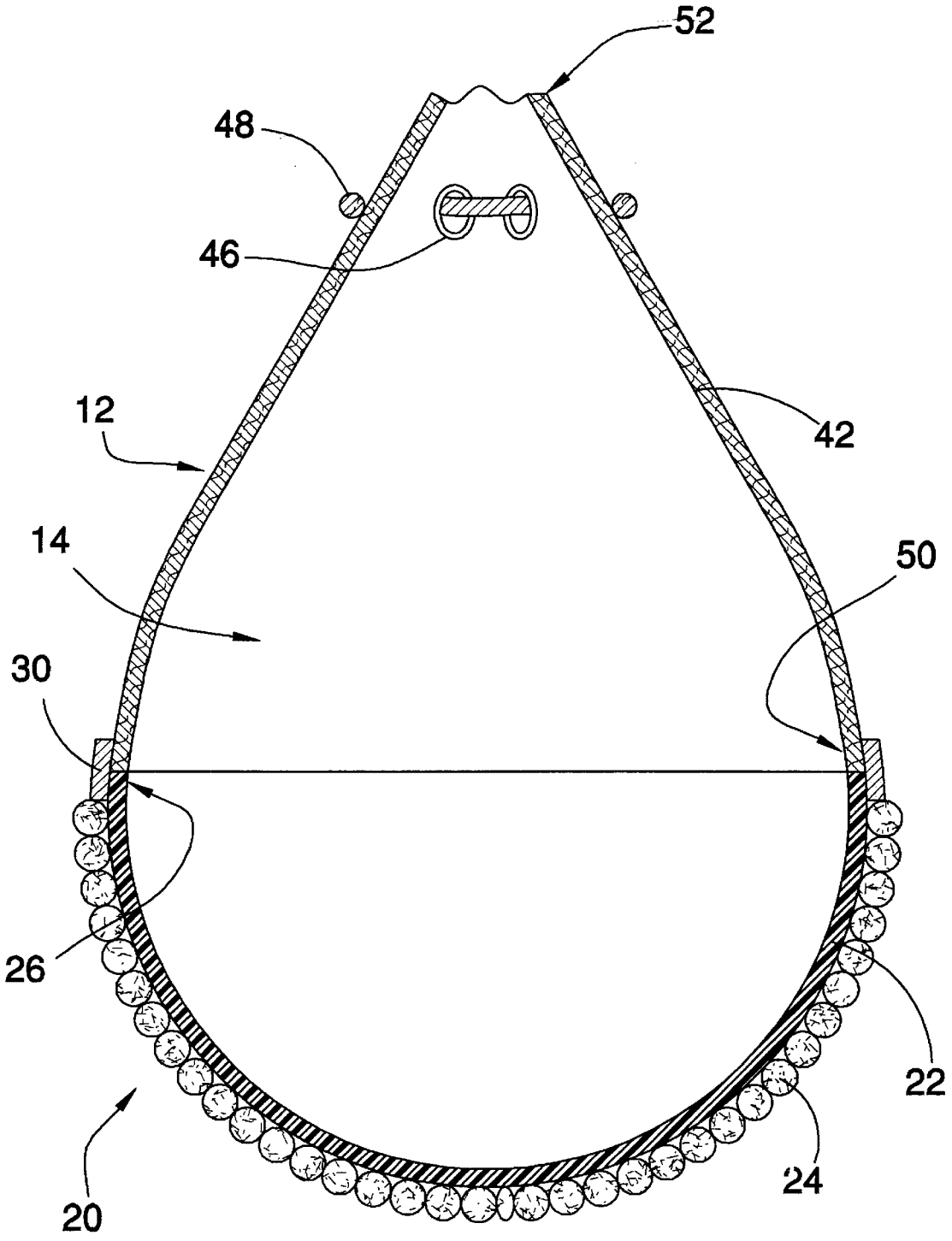
FIG. 6 is a cross sectional view of an embodiment of the present invention.

With reference now to the drawings, and in particular to FIGS. 1 through 6 thereof, a new handbag embodying the principles and concepts of the present invention and generally designated by the reference numeral 10 will be described.

As best illustrated in FIGS. 1 through 6, the handbag 10 generally comprises a bag in the shape of a calabash fruit. The calabash tree (*Crescentia cujete*) produces a fruit with a gourd or pair shape having a bulbous or spherical bottom sloping to a conical top. The shape should not be confused with the distinctive silhouette of the calabash pipe.

The handbag 10 may comprise three sections consisting of a lower section 20, a medial band 30 and an upper section 40. The handbag may also have an exterior 12 and an interior 14. The interior 14 may be used to store and carry personal effects as is commonly practiced with other types of handbags. The exterior 12 of the handbag may include ornamental or eye pleasing colors, textures, patterns or graphics. The exterior may also posses a texture that is pleasant to touch, handle or carry.

The lower section 20 may comprise a structural foundation in the form of a bowl or hemisphere. This bowl material 22 may be composed of rigid, semi rigid or pliable materials such as, for example, metal, plastic, rubber, formed leather, felt, carbon composites, etc. The bowl material 22 may be designed to generally retain its shape despite the contents of the bag's interior 14. The relative rigidity of the handbag 10 may be provided by the joining of multiple layers or plies of bowl material 22. The exterior 12 of the lower section 20 may include a covering of soft or yielding material such as, for example, batting covered in fabric, fur, corduroy, foam rubber covered in fabric, gathered or gusseted lace, upholstered padding, etc. One preferred embodiment, which is depicted in the figures, comprises a contoured spiral of cord 24 applied to the bowl material 22. The cord may provide a soft, yielding exterior 12 that would be pleasant to the eye and touch. The use of cord may also offer a variety of styles, colors and textures, which is important in matching the handbag 10 accessory with other clothing fashions. The malleable nature of the exterior treatment of the lower section 20 may also assist in keeping the handbag 10 in an upright position when free standing. The lower section may be connected to the upper section 40 at the lower sections upper rim 26. The means of attachment may include, for example, a sewn seam, an adhesive, a series of rivet or stud fasteners, a melted weld, etc.

The medial band 30 may provide both a functional as well as an esthetic junction between the lower section 20 and the upper section 40. The medial band may be constructed of a variety of materials such as, for example, fabric, leather, fur, plastic, metal, ceramic, rubber, wood, stone, horn, ivory, etc. The medial band 30 may be relatively more rigid or relatively less rigid than the lower section. A relatively greater amount of rigidity may assist the handbag 10 to retain the calabash form. The medial band 30 may be connected at the upper rim 26 of the lower section 20 and/or the lower edge 50 of the upper section 40. The means of attachment might include, for example, a sewn seam, adhesives, series of rivet or stud fasteners, melted weld, etc., and may be a means of attachment similar to the joining of the lower section to the upper section. The width of the medial band 30 may be as wide or as narrow as the particular esthetic design or functional need may require. The medial band 30 may span the circumference of the handbag 10 and cover the upper rim 26 of the lower section 20 and/or lower edge 50 of the upper section 40. A portion of the junction between the materials comprising the lower section 20 and the materials comprising the upper section 40 may be covered by the medial band 30. The medial band may hide the visible evidence of the method of joining the lower section 20 to the upper section 40. The medial band may also be the medium for attaching the lower section 20 to the upper section 40, as the lower section 20 and the upper section 40 may not be directly attached to each other. In this case, both the lower section 20 and the upper section 40 may be joined to the medial band directly.

The medial band may include a drawstring fastener 32 for attaching the drawstring 48. The drawstring fastener 32 may take various forms, such as, for example, a closed loop, an open loop with closing fastener, a tie down, a spring clip, a hook, a split ring, etc. One preferred embodiment (depicted in the figures) includes a loop of material with at least one end terminating in a decouplable fastener or snap.

The upper section 40 may be composed of a pliable material 42 such as, for example, fabric, plastic, leather, netting, rubber, etc. The pliable material 42 may come in a variety of colors, textures and may include decorations or graphics on its exterior 12 and/or interior 14 sides. The shape of the upper section 40 may generally form a sleeve in the form of a cylinder, funnel, or cone, that is open at the top and bottom. The lower edge 50 of the upper section 40 may be attached to the upper rim 26 of the lower section 20 and/or to the medial band 30. The upper edge 52 of the upper section 40 may define an aperture 44 for accessing the interior 14 of the handbag 10. Near the upper edge 52 of the upper section 40, the handbag 10 may include eyelets 46. The eyelets 46 may be set in a ring near the upper edge 52 of the pliant material 42. The eyelets 46 may be used in conjunction with a drawstring 48 or draw tape to gather the upper edge of the pliable material 42 together to close the aperture 44. The drawstring 48 may comprise an elongated material such as, for example, cotton, hemp, jute, leather, flax, silk, wool, rubber, nylon, rayon, Kevlar, vinyl, etc. that is formed into a cord, rope, line, lace, band or tape.

The drawstring 48 may be an elongated member possessing two ends or may be joined in a continuous loop. Optionally, the ends of an elongated drawstring may include fasteners to join the two ends together to form a loop. The ends of an elongated drawstring may also be simply tied to each other to form a loop. The drawstring 48 may be threaded through the eyelets 46 set in the pliable material 42 so that, by drawing the ends or a section of the drawstring 48 from the interior 14 to the exterior 12 of the handbag 10, the aperture 44 is decreased in size to close the aperture. The drawstring 48 may be attached to the drawstring fastener 32 of the medial band 30. The methods of attachment may include, for example, looping the first end of the drawstring 48 through the closed loop of the drawstring fastener 32 and attaching the first end to the second end of the draw string, capturing the closed loop of the drawstring 48 in a drawstring fastener clip, tying the drawstring to the drawstring fastener cord, etc. The embodiment depicted in FIGS. 1 and 2 has a drawstring in the form of a continuous loop passed through a second cord which has both ends attached to the medial band 30. The attachment may be fixed or may include a decouplable fastener such as a snap.

The loop formed by the drawstring 48 between the upper edge 52 of the upper section 40 and the drawstring fastener 32 of the medial band 30 may be used as a handle carry the handbag 10. The length of the drawstring 48 may be of sufficient length to allow the loop to be used as a shoulder strap or harness. While the handbag 10 is being carried, the aperture 44 remains in a relatively closed position due to the pull being exerted on the drawstring 48 due to the weight of the handbag 10 and the personal effects stored in the interior 14.

The drawstring 48 may include a mechanism to retain the drawstring 48 outside the interior 14 of the handbag 10 thus keeping the aperture in a closed position. Such devices are well known in the industry and are referred to as drawstring spring clamps 60. The drawstring spring clamp 60 may comprise an inner block 68 and an outer block 62 both possessing a throughput 66. The outer block may also include a cavity 64 that retains the inner block 68 so that the drawstring 48 can pass through both throughputs 66 simultaneously. A spring 70 mounted in the cavity between the inner block 68 and the outer block 62 may provide a bias to clamp or bind the drawstring in the spring clamp 60.

In use, the aperture of the handbag 10 may be opened by pulling apart the gathered upper edges 52 of the pliable material. This action would separate the individual eyelets 46 and extend the drawstring 48 between the eyelets increasing the size of the aperture 44. The user could then access the interior of the handbag 10 to insert or remove items. To close the handbag 10, the drawstring 48 would be pulled away from one or more of the eyelets 46 on the exterior 12. This action would decrease the space between the eyelets and decrease the size of the aperture 44. The drawstring could then be attached to the drawstring fastener 32 located on the medial band 30. Optionally, a spring clamp 60 may be unclamped and slid down the drawstring 48 to the eyelet 46. By releasing the spring bias, the drawstring 48 would be held in place by restricting the drawstring 48 from being drawn back and opening the aperture 44. The handle formed by the drawstring attached to the medial band 30 may then be grasped to carry the handbag 10. It the drawstring 48 was of sufficient length, the loop may be used to drape the handbag 10 over the user's shoulder in the fashion of a shoulder strap.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handbag comprising:

a lower section comprising:

a semi-rigid material forming a bowl;

a soft outer covering encompassing the semi rigid material;

an upper section comprising:

a sleeve of pliant material connected to the lower section and forming an aperture of the handbag at an upper edge of the sleeve;

eyelets set in a ring near the upper edge of the sleeve of pliant material;

a drawstring threaded through the eyelets adapted to close the aperture by drawing the drawstring out and away from the eyelets;

a medial band located at the junction of an upper rim of the lower section and a lower edge of the upper section; and wherein the medial band connected the lower section to the upper section.

2. The handbag of claim 1 wherein and exterior of the handbag resembles the form of a calabash fruit.

3. The handbag of claim 1 wherein the lower section is pliable but is sufficiently rigid to retain a bowl shape.

4. The handbag of claim 1 wherein the pliant material of the sleeve comprises a fabric.

5. The handbag of claim 1 wherein the sleeve of pliant material has a cylindrical form.

6. The handbag of claim 1 wherein the sleeve of pliant material has a funnel form.

7. The handbag of claim 1 wherein the sleeve of pliant material has a conical form.

8. The handbag of claim 1 wherein the drawstring comprises a continuous loop.

9. The handbag of claim 1 wherein the drawstring comprises an elongated member with two ends.

10. The handbag of claim 9 additionally comprising a fastening device for fastening together the ends of the drawstring.

11. The handbag of claim 1 wherein the medial band conceals a junction between the lower section and the upper section.

12. The handbag of claim 1 additionally comprising a spring clamp for retaining the drawstring in a constricted condition in eyelets with the aperture in a closed position.

13. A handbag comprising:

a lower section comprising:

a semi-rigid material forming a bowl;

a soft outer covering encompassing the semi rigid material;

an upper section comprising:

a sleeve of pliant material connected to the lower section and forming an aperture of the handbag at an upper edge of the sleeve;

eyelets set in a ring near the upper edge of the sleeve of pliant material;

a drawstring threaded through the eyelets adapted to close the aperture by drawing the drawstring out and away from the eyelets;

a medial band located at the junction of an upper rim of the lower section and a lower edge of the upper section; and wherein the soft outer covering of the lower section comprises a coil of cord conforming to a bowl shape of the lower section.

14. A handbag comprising:

a lower section comprising:

a semi-rigid material forming a bowl;

a soft outer covering encompassing the semi rigid material;

an upper section comprising:

a sleeve of pliant material connected to the lower section and forming an aperture of the handbag at an upper edge of the sleeve;

eyelets set in a ring near the upper edge of the sleeve of pliant material;

a drawstring threaded through the eyelets adapted to close the aperture by drawing the drawstring out and away from the eyelets;

a medial band located at the junction of an upper rim of the lower section and a lower edge of the upper section; and wherein the medial band includes a fastener for attaching the drawstring to the medial band.

15. The handbag of claim 14 wherein the drawstring attached to the medial band forms a loop which may be used as a carrying handle.

16. The handbag of claim 15 wherein the loop formed by the drawstring attached to the medial band is of sufficient length to use the loop as a shoulder strap.

* * * * *